US009616445B2

(12) United States Patent
Ciavarella et al.

(10) Patent No.: US 9,616,445 B2
(45) **Date of Patent: *Apr. 11, 2017**

(54) FOAM PUMPS WITH LOST MOTION AND ADJUSTABLE OUTPUT FOAM PUMPS

(71) Applicant: GOJO Industries, Inc., Akron, OH (US)

(72) Inventors: Nick E. Ciavarella, Seven Hills, OH (US); Cory J. Tederous, Stow, OH (US); John J. McNulty, Broadview Heights, OH (US); Mark E. Rosenkranz, Elyria, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/584,444

(22) Filed: Dec. 29, 2014

(65) Prior Publication Data

US 2015/0136808 A1 May 21, 2015

Related U.S. Application Data

(63) Continuation of application No. 13/791,332, filed on Mar. 8, 2013, now Pat. No. 8,955,718.
(Continued)

(51) Int. Cl.
*B67D 7/76* (2010.01)
*B05B 11/00* (2006.01)
(Continued)

(52) U.S. Cl.
CPC ..... *B05B 11/3087* (2013.01); *A47K 5/12* (2013.01); *B05B 7/0025* (2013.01);
(Continued)

(58) Field of Classification Search
CPC ..... B05B 11/3087; B05B 7/0025; B05B 11/3015; B05B 11/3042; B05B 7/0018;
(Continued)

(56) References Cited

U.S. PATENT DOCUMENTS 2,904,222 A 9/1959 Philippe
3,226,035 A 12/1965 Sonia
(Continued)

FOREIGN PATENT DOCUMENTS

CH 676227 A5 12/1990
EP 1147818 A1 10/2001
(Continued)

OTHER PUBLICATIONS

European Patent Office Search Report issued Jan. 7, 2011 in EP Application No. 09 150 880.2; 4 pages.
(Continued)

*Primary Examiner* — Patrick M Buechner
(74) *Attorney, Agent, or Firm* — Calfee, Halter & Griswold LLP

(57) ABSTRACT

Embodiments of lost motion foam pumps are disclosed herein. One exemplary embodiment includes a liquid chamber, a liquid piston movable in the liquid chamber, an air chamber and an air piston movable in the air chamber. The air piston is linked to the liquid piston. A connector is linked to the air piston or the liquid piston. The connector includes an engagement member for connecting to an actuator of a foam dispenser. Movement of the actuator in a first direction moves the liquid and air pistons to contract the liquid chamber and the air chamber. Movement of the actuator a first distance in a second direction does not move the liquid piston or the air piston; however, continued movement of the
(Continued)

actuator a second distance in the second direction moves the liquid piston and the air piston and expands the liquid and air chambers.

20 Claims, 7 Drawing Sheets

Related U.S. Application Data

(60) Provisional application No. 61/720,490, filed on Oct. 31, 2012.

(51) Int. Cl.

| | |
|---|---|
| ***F04B 53/14*** | (2006.01) |
| ***B05B 7/00*** | (2006.01) |
| ***A47K 5/12*** | (2006.01) |
| *A47K 5/14* | (2006.01) |

(52) U.S. Cl.
CPC ..... *B05B 11/3015* (2013.01); *B05B 11/3042* (2013.01); *F04B 53/14* (2013.01); *A47K 5/14* (2013.01)

(58) Field of Classification Search
CPC ..... B05B 11/3009; B05B 11/3011; B05B 11/309; A47K 5/12; A47K 5/14; F04B 53/14
USPC ..... 222/181.1–181.3, 190, 325, 383.1; 417/521, 523, 568, 533; 92/152
See application file for complete search history.

(56) References Cited

U.S. PATENT DOCUMENTS

| | | | | |
|---|---|---|---|---|
| 3,851,801 | A | 12/1974 | Roth | |
| 4,029,261 | A | 6/1977 | Olegnowicz | |
| 4,168,020 | A | 9/1979 | Benson | |
| 4,330,071 | A | 5/1982 | Ohlson | |
| 4,793,522 | A | 12/1988 | Corsette | |
| 4,880,161 | A | 11/1989 | Wright | |
| 4,986,453 | A | 1/1991 | Lina et al. | |
| 5,271,530 | A | 12/1993 | Uehira et al. | |
| 5,398,845 | A | 3/1995 | Meyer | |
| 5,439,140 | A | 8/1995 | Meyer | |
| 5,445,288 | A | 8/1995 | Banks | |
| 5,458,289 | A * | 10/1995 | Cater | B05B 11/0018 222/321.2 |
| 5,462,208 | A | 10/1995 | Stahley et al. | |
| 5,482,187 | A | 1/1996 | Poulsen et al. | |
| 5,544,788 | A | 8/1996 | Meyer | |
| 5,556,268 | A | 9/1996 | Topper et al. | |
| 5,826,755 | A | 10/1998 | Burd | |
| 5,862,954 | A | 1/1999 | Ehrensperger | |
| 5,899,363 | A | 5/1999 | Bliss, III et al. | |
| 5,906,299 | A | 5/1999 | Hagleitner | |
| 6,036,057 | A | 3/2000 | Poutiatine | |
| 6,065,647 | A | 5/2000 | Bliss, III et al. | |
| 6,422,434 | B1 | 7/2002 | Lammond Wass et al. | |
| 6,446,840 | B2 | 9/2002 | Ophardt et al. | |
| 6,612,468 | B2 | 9/2003 | Pritchett et al. | |
| 6,763,978 | B2 | 7/2004 | Pritchet et al. | |
| 7,059,282 | B2 | 6/2006 | Vorih et al. | |
| 7,337,930 | B2 | 3/2008 | Ophardt et al. | |
| 7,377,758 | B2 | 5/2008 | Sallows et al. | |
| 7,815,076 | B2 | 10/2010 | Ophardt | |
| 8,109,415 | B2 | 2/2012 | Tu | |
| 8,430,273 | B2 | 4/2013 | Brouwer | |
| 8,528,792 | B2 * | 9/2013 | Ophardt | B05B 11/007 222/181.2 |
| 8,579,159 | B2 | 11/2013 | Ciavarella | |
| 8,733,588 | B2 | 5/2014 | Ophardt et al. | |
| 8,955,718 | B2 * | 2/2015 | Ciavarella | F04B 53/14 222/190 |
| 2003/0000967 | A1 | 1/2003 | Ehrensperger | |
| 2004/0031816 | A1 | 2/2004 | Schuman | |
| 2004/0065689 | A1 * | 4/2004 | Pritchett | B05B 11/3011 222/321.7 |
| 2004/0206772 | A1 | 10/2004 | Leifheit | |
| 2006/0261083 | A1 | 11/2006 | Ophardt et al. | |
| 2006/0283887 | A1 | 12/2006 | Jahan et al. | |
| 2008/0272148 | A1 | 11/2008 | Malik et al. | |
| 2009/0039111 | A1 | 2/2009 | Tu | |
| 2010/0096412 | A1 | 4/2010 | Law | |
| 2011/0079614 | A1 | 4/2011 | Ganzeboom et al. | |
| 2011/0168739 | A1 | 7/2011 | Brouwer | |
| 2013/0112716 | A1 * | 5/2013 | Law | A61M 11/00 222/256 |
| 2013/0315031 | A1 | 11/2013 | Bunoz et al. | |
| 2015/0144661 | A1 * | 5/2015 | Tepas | B05B 7/0037 222/190 |

FOREIGN PATENT DOCUMENTS

| | | | |
|---|---|---|---|
| EP | 2080560 | A1 | 7/2009 |
| GB | 1269545 | | 4/1972 |
| GB | 2301812 | | 12/1996 |
| GB | 2472235 | | 2/2011 |
| WO | 2011157975 | A1 | 12/2011 |

OTHER PUBLICATIONS

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

International Search Report from International Application No. PCT/US2014/012440 dated Apr. 8, 2014.

* cited by examiner

FOAM PUMPS WITH LOST MOTION AND ADJUSTABLE OUTPUT FOAM PUMPS

RELATED APPLICATIONS

This non-provisional utility patent application is a continuation of U.S. Non-Provisional application Ser. No. 13/791,332 filed on Mar. 8, 2013, entitled FOAM PUMPS WITH LOST MOTION AND ADJUSTABLE OUTPUT FOAM PUMPS, which application claims priority to and the benefits of U.S. Provisional Patent Application Ser. No. 61/720,490 filed on Oct. 31, 2012, entitled FOAM PUMPS WITH LOST MOTION AND ADJUSTABLE OUTPUT FOAM PUMPS. These applications are incorporated herein by reference in their entirety.

TECHNICAL FIELD

The present invention relates generally to pumps, refill units for foam dispensers and foam dispensers, and more particularly to pumps having adjustable outputs and/or lost motion linkage, refill units using such pumps and dispensers for such refills.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles by use of an air pump or air compressor. Most foam pumps have a constant volume output and to change the volume requires one to change the pump or "short stroke" the pump. A foam pump is short stroked when a user rapidly pushes a dispense actuator and the pump does not have time to move back to it rest position, or the dispenser or a user prevents the actuator from returning to its full stroke before actuating the actuator an additional time. Problems often occur with foam pumps when they are short stroked. If a blocking plate is added to the dispenser actuator so that the actuator does not drive the liquid piston to its full length, many pumps will not prime because an air bubble remains in the liquid piston. Another problem is that air trapped in the liquid piston results in an inconsistent output.

SUMMARY

Embodiments of lost motion foam pumps are disclosed herein. One exemplary embodiment includes a liquid chamber, a liquid piston movable in the liquid chamber, an air chamber and an air piston movable in the air chamber. The air piston is linked to the liquid piston. A connector is linked to the air piston or the liquid piston. The connector includes an engagement member for connecting to an actuator of a foam dispenser. Movement of the actuator in a first direction moves the liquid piston and the air piston and contracts the liquid chamber and the air chamber, respectively. Movement of the actuator a first distance in a second direction does not move the liquid piston or the air piston; however, continued movement of the actuator a second distance in the second direction moves the liquid piston and the air piston and expands the liquid and air chambers.

Exemplary embodiments of adjustable output foam pumps are also disclosed herein. One exemplary embodiment includes an air piston and a liquid piston. The air piston is linked to the liquid piston. An engagement member is operably connected to the liquid piston and the air piston. The engagement member includes a first securing position and a second securing position. When an actuator is connected to the first securing position, the foam pump has a first configuration and when the actuator is connected to the second securing position, the foam pump has a second configuration having a different output.

In addition, exemplary embodiments of foam pumps are also disclosed. In one embodiment, the foam pump includes a liquid piston for a liquid pump and an air piston for an air pump linked to the liquid pump. A connector links the pistons to an actuator. During operation, the stroke of the actuator is greater than the stroke of the liquid piston and the air piston.

BRIEF DESCRIPTION OF THE DRAWINGS

These and other features and advantages of the present invention will become better understood with regard to the following description and accompanying drawings in which.

DETAILED DESCRIPTION

Exemplary embodiments of foam pumps disclosed herein alleviate problems of allowing air into the liquid pump when the pump is short stroked. In addition, exemplary embodiments of the foam pumps disclosed herein also allow different dosages to be dispensed. Some of the exemplary embodiments are field adjustable. Thus, in some embodiments, one refill unit may be used in several different situations that call for different dosages per operation of the actuator, lost motion, no lost motion or combinations thereof.

Figure 1:
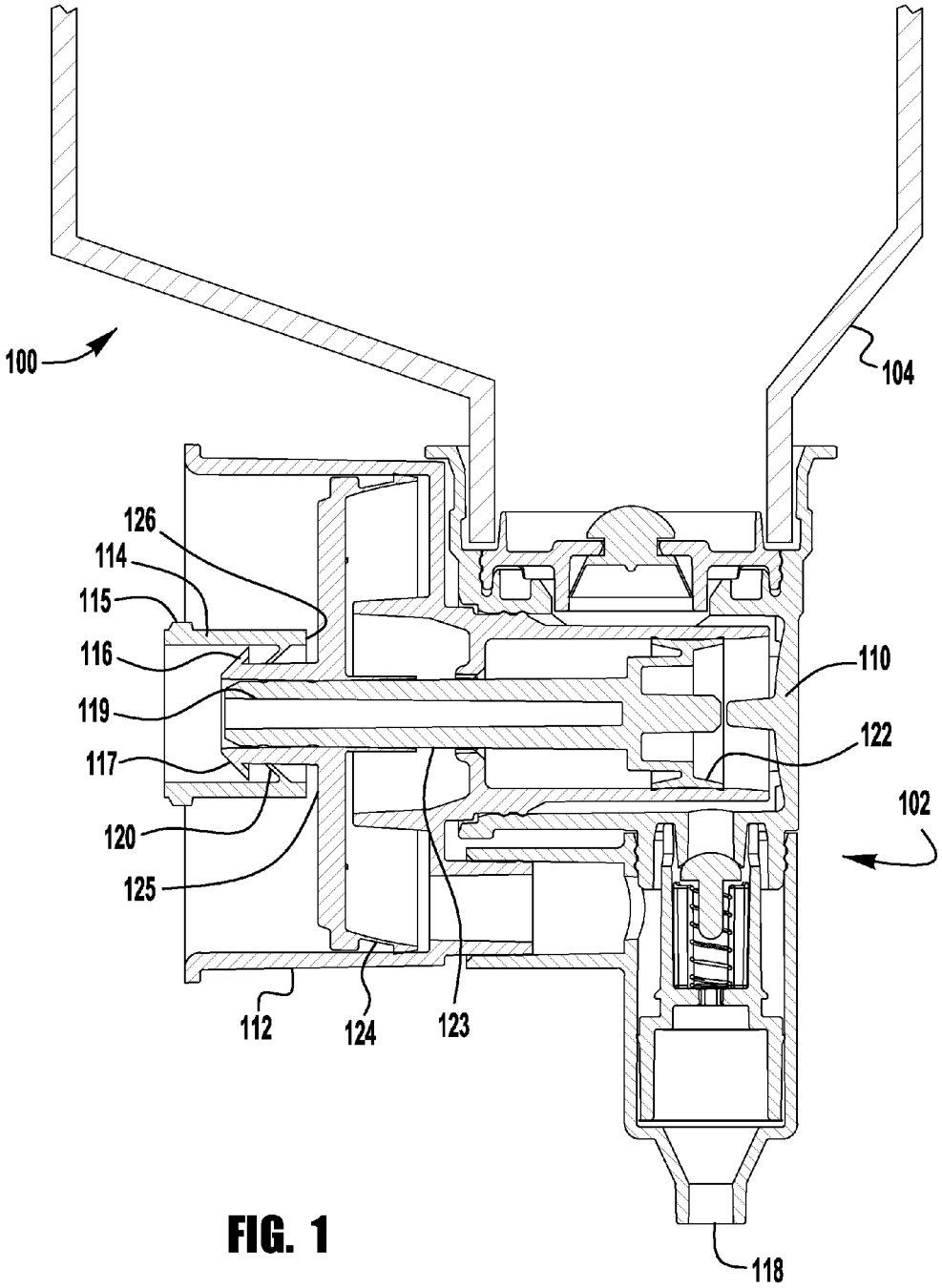
FIG. 1 illustrates an exemplary embodiment of a refill unit having a foam pump secured to a container.

FIG. 1 illustrates an exemplary embodiment of a refill unit 100 for a foam dispenser (not shown). A foam dispenser for use with the embodiments described herein generally includes a housing for receiving the refill unit 100 and an actuator for driving the foam pump and causing the dispenser to dispense foam. The foam dispenser may be manually operated or electrically operated. Refill unit 100 includes a container 104 and a foam pump 102. The foam pump 102 includes an air pump portion 112, a liquid pump portion 110, a connector 114 and a foam outlet 118.

Many of the components of foam pump 102 are substantially similar to the embodiments of foam pumps disclosed in co-pending U.S. patent application Ser. No. 61/695,140, filed on Aug. 30, 2012, titled Horizontal Pumps, Refill Units and Foam Dispensers, and U.S. patent application Ser. No. 61/719,618 filed on Oct. 29, 2012 also titled Horizontal Pumps, Refill Units and Foam Dispensers, both of which are incorporated herein in their entirety by reference. Detailed operation of the foam pumps may be better understood be referring to these applications. Embodiments of these foam pumps, liquid pumps and other foam pumps may be modified to be lost motion pumps. Foam pump 102 includes a lost motion connector 114. Lost motion connector 114 includes annular projection 115 which is used to link the liquid piston 122 and air piston 124 to an actuator not shown. In this embodiment, lost motion connector 114, which includes a first angled annular projection 120, links to air piston 124, which includes a second angled annular projection 116. The first angled annular projection 120 is pushed over the second angled annular projection 116. The annular projections 116, 120 deflect and return to their original positions to secure the lost motion connector 114 to the air piston 124. Liquid piston 122 includes a shaft 123 that engages with cylindrical projection 117 of the air piston 124 and connects the liquid piston 122 to the air piston 124. During actuation, an actuator pushes lost motion connector 114 inward. Push side 126 of lost motion connector 114 pushes against a surface 125 of air piston 124 to move air piston 124 and liquid piston 122 inward to dispense a dose of foam. During operation, the liquid piston 122 and air piston 124 travel to the end of the foam pump stroke; however, when the actuator (not shown) moves outward, the lost motion connector 114 moves outward, but the liquid piston 122 and the air piston 124 do not move until first angled projecting member 120 contacts second angled projection member 116; thus, a first portion of the distance moved by lost motion connector 114 does not move air piston 124 or liquid piston 122, resulting in "lost motion." The lost motion may be adjusted to vary the output dose by, for example, adjusting the position of first angled annular projection 120. The lost motion may be adjusted to obtain any output dose that is a percentage of a full dose such as, for example, 90%, 80%, 70%, 60%, 50% or any other percentage of a full dose.

In some embodiments, the connector 114 is part of the actuator and a separate connector need not be used. Many different types of connectors may be used to connect the actuator (not shown) to the foam pump 102 that results in movement of the liquid piston 122 and air piston 124 to the end of their respective strokes (i.e. fully discharging the cylinders) while not returning the liquid piston 122 and air piston 124 to the outermost possible ends of their strokes (i.e. not fully recharging the cylinders). Several additional exemplary embodiments are disclosed in greater detail below.

In addition, in some embodiments, the lost motion occurs between the actuator and either the liquid or air pistons, so that, for example, there is no lost motion between the actuator and the air piston, but there is lost motion with respect to the liquid piston. In some embodiments, the lost motion occurs between the liquid piston and the air piston. In various embodiments, the lost motion occurs between any combination of the linkage to the actuator, the linkage to the air piston or the linkage to the liquid piston.

Figure 2:
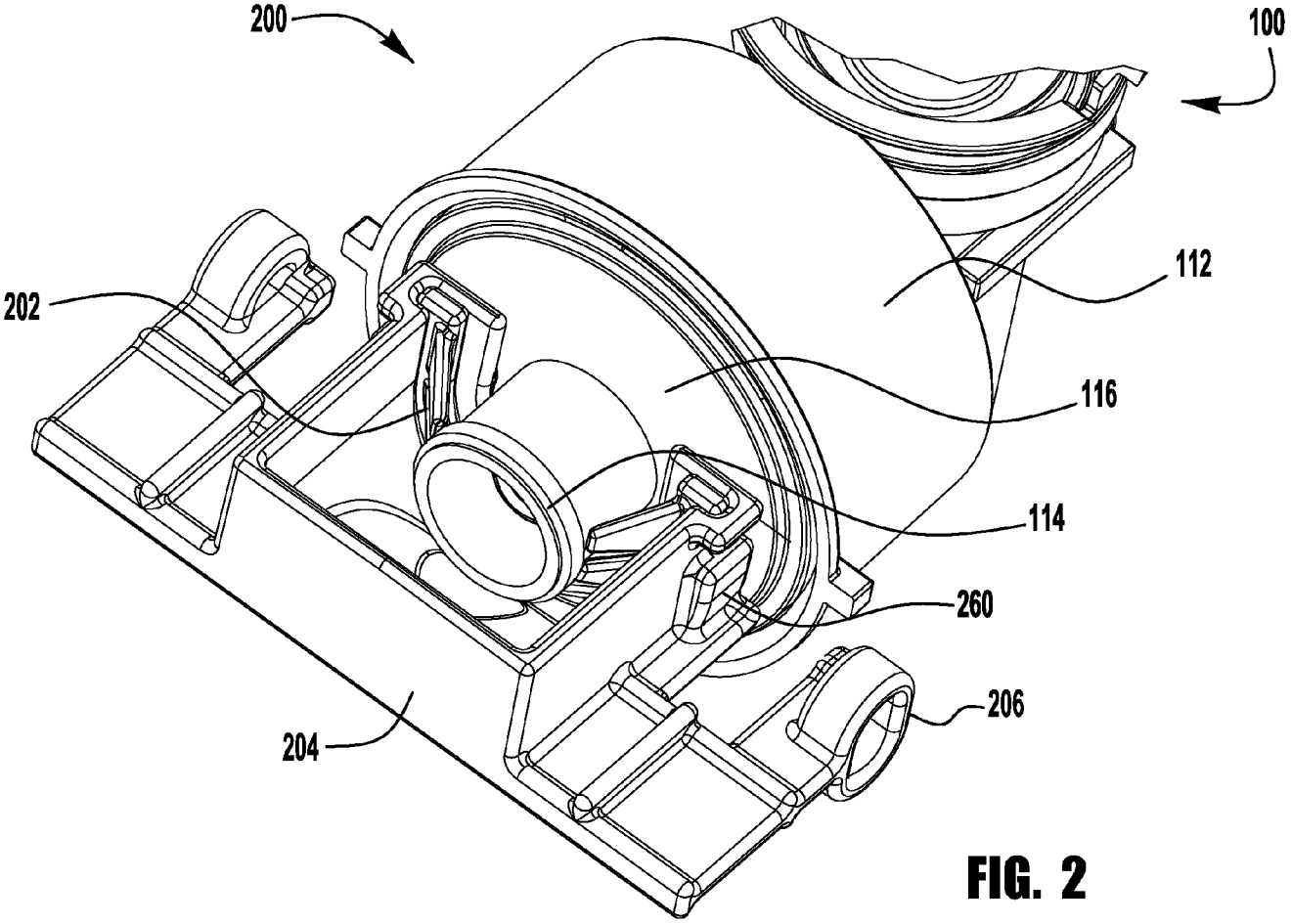
FIG. 2 illustrates a cross-section of the exemplary refill unit of FIG. 1 engaged with an actuator for an electronic dispenser.

FIG. 2 illustrates a partial view of an exemplary embodiment of part of a pump and refill unit 100 installed in a dispenser 200 having an actuator 204. The exemplary dispenser includes a housing (not shown), wherein the actuator 204 is movably connected to the housing, such that actuator 204 may be moved relative to the housing to actuate the dispenser. Actuator 204 may be manually or electrically operated. In some embodiments, the housing encloses the container 104 and foam pump 102. In such embodiments, container 104 may be a collapsible container that collapses when the foamable liquid is removed. In some embodiments, the housing encloses only a portion of the refill unit 100. In such embodiments, container 104 may be vented so that it does not collapse when the foamable liquid is removed.

Figure 2A:
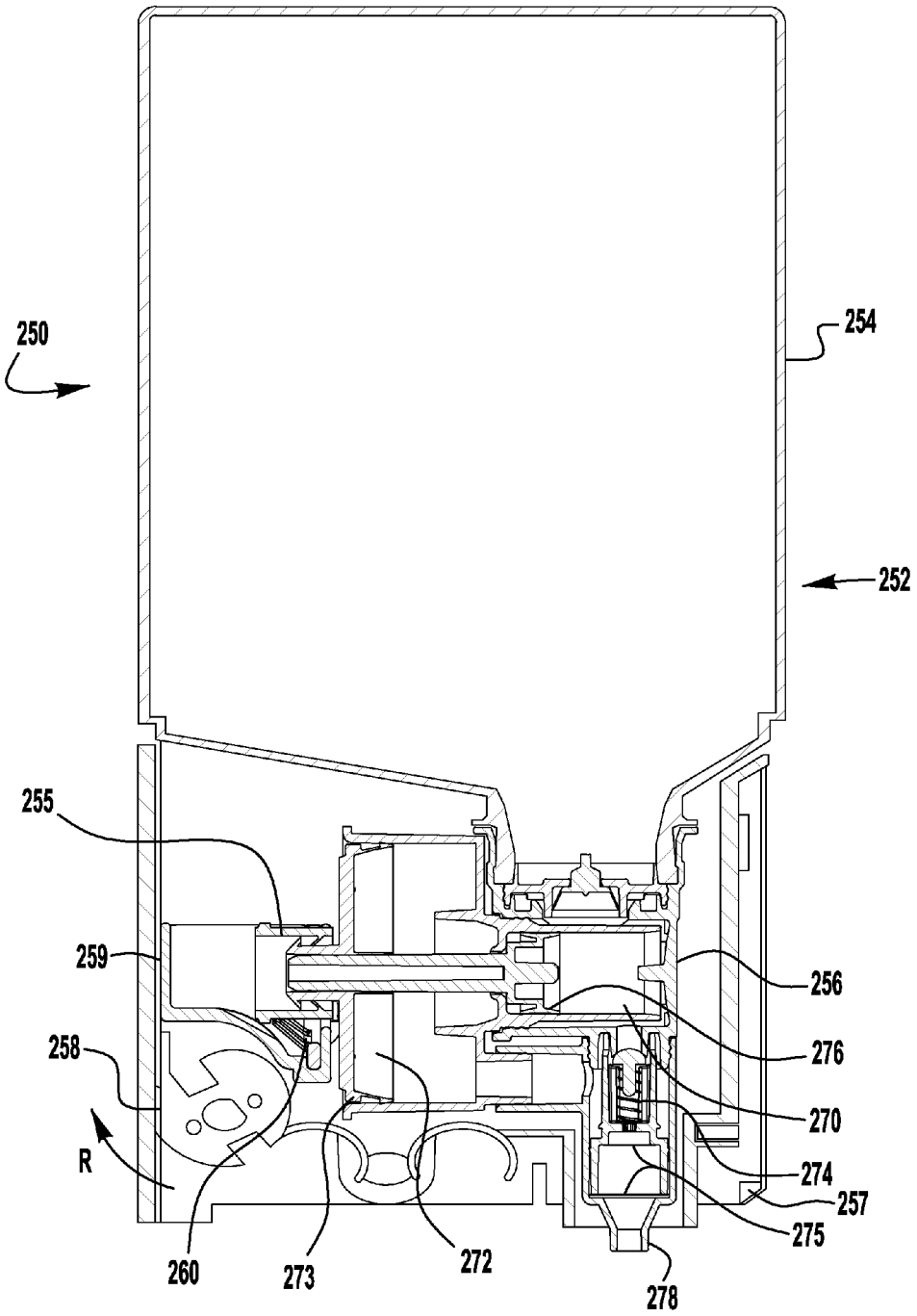
FIG. 2A illustrates a cross-section of an exemplary refill unit in an exemplary electronic dispenser.

As can be seen from FIG. 2, lost motion connector 114 of refill unit 100 lowers into engagement member 202 (see also FIG. 3, which illustrates the flexible fingers of connector engagement member 202 without the rest of actuator 204 for clarity) of the actuator 204. Actuator 204 includes connectors 206 for connecting to actuator drive 258 (FIG. 2A). Engagement member 202 includes a plurality of flexible fingers 302. Flexible fingers 302 partially surround connector 114 leaving the upper section open. Refill unit 100 may be disengaged from engagement member 202 by lifting the refill unit 100 upward.

To install refill unit 100, the refill unit 100 is lowered so that the annular projection 304 of connector 114 is located behind the end of flexible fingers 302. When the refill unit 100 is lowered into position, flexible fingers 302 flex outward and put pressure on connector 114. The flexible fingers 302 do not return to an unflexed position when refill unit 100 is installed in the dispenser and keep pressure on connector 114. If refill unit 100 is installed in the dispenser and the annular projection 304 is not located behind the flexible fingers 302, the first time the actuator 204 moves to engage the pump 102, the flexible fingers 302 contact connector 114 and expand to allow annular projection 304 to pass by the ends of flexible fingers 302. Once the annular projection 304 moves past the end of the flexible fingers 302, the flexible fingers 302 snap down on connector 114 in front of annular projection 304 and link the actuator 204 to the connector 114. In some embodiments, flexible fingers 302 are not fingers, but rather a flexible one-piece member that is flexible enough to expand and latch onto annular projection 304 of connector 114.

FIG. 2A illustrates an exemplary embodiment of an electronic foam dispenser 250 having lost motion. Foam dispenser 250 includes a refill 252 having a container 254 and a foam pump 256. Foam pump 256 is substantially the same as foam pump 102. Dispenser 250 includes an actuator drive 258 that rotates about an axis. Actuator drive 258 is rotated by an electric motor. In operation, sensor 257 detects an object and causes actuator drive 258 to rotate. As actuator 258 rotates, linkage causes actuator 259 to move inward. Actuator 259 connects to lost motion connector 255 with engagement member 260. Movement of actuator 259 inward forces liquid out of liquid pump chamber 270 and air out of air chamber 272. The liquid and air are mixed together in mixing chamber 274 and are forced through mix media 275, which may be a mixing cartridge, screens, sponge, baffles or the like and out of outlet 278 in the form of a foam. At the end of the stroke, actuator drive 258 rotates actuator 259 back to its rest position and also expands the air chamber 272 and liquid chamber 270 by moving air piston 273 and liquid piston 276 back to a partially charged state. The air chamber 272 and liquid chamber 270 are moved back to a partially charged state because of the lost motion caused by lost motion connector 255. Again, the percentage of the charge volume may be adjusted by simply changing the configuration of lost motion connector 255.

Figure 3:
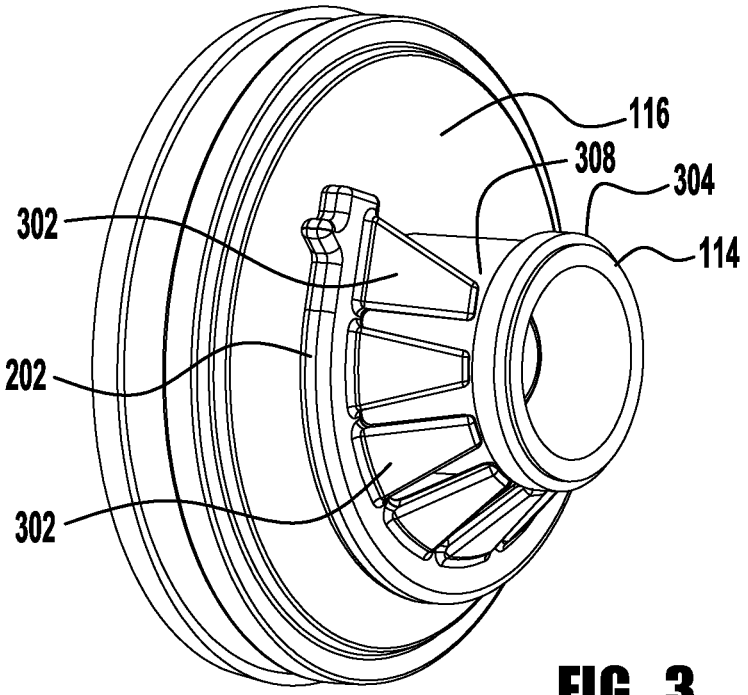
FIG. 3 illustrates a prospective view of the exemplary engagement mechanism of FIG. 2.

As can be seen in FIG. 3, there is a gap 308 between fingers 302 that connect to an actuator (not shown) and annular projection member 304. Gap 308 provides lost motion between the lost motion connector 114 and the actuator (not shown). The width of gap 308 may be varied to arrive at a desired lost motion. Thus, either part of lost motion connector 114 can be used to create lost motion. Accordingly, such lost motion connectors may be used together, separately, or in combination with other elements. In addition, a lost motion connector may be a projection on the pump piston that has a lost motion connection at the point of connection to the actuator. Optionally, the lost motion connector may be linkage in the dispenser that allows the dispensing actuator to move the piston to the end of its stroke (or fully discharged position), but has slop or play in the linkage so that the return stroke does not move the piston all the way to the beginning (or fully charged position) of its stroke. The lost motion occurs at the back or return stroke of the pump. Accordingly, the pump piston always moves to its end of stroke length, but if lost motion is utilized, the pump piston does not return to the beginning of its stroke length, i.e. the lost motion is in the charging direction, not the pump dispensing direction.

Figure 4:
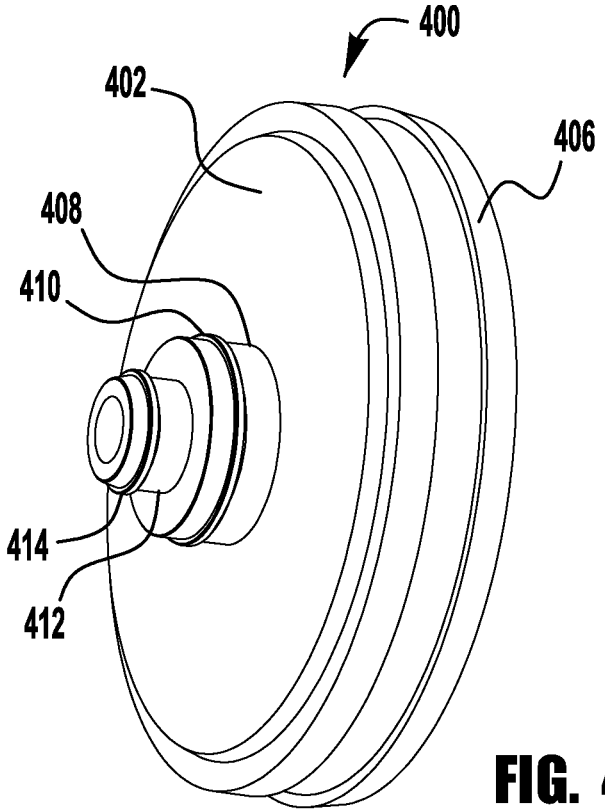
FIG. 4 illustrates an exemplary embodiment of an air piston having multiple connection points for adjusting the output volume of a foam pump.

FIG. 4 illustrates a prospective view of an exemplary air piston 400 for use in embodiments of foam pumps that have adjustable output dosages. Air piston 400 includes sealing member 406 for engaging a wall of a cylindrical air chamber (not shown). Air piston 400 includes a surface 402 that includes a first annular projection 408. First annular projection 408 includes a first rib 410. Air piston 400 includes a second annular projection 412 that includes a second rib 414. A connection member (not shown) is secured to an actuator (not shown) of a dispenser and is configured to engage either first rib 410 or second rib 414. When the connection member engages the first rib 410, the actuator (not shown) will move the air piston 400 (and linked liquid piston, not shown) all the way outward to the end of its stroke so that the pump is fully charged. When the connection member engages the second rib 414, the actuator (not shown) will move the air piston 400 (and linked liquid piston, not shown) outward, but only part of the way to the end of its stroke (i.e. so that the pump is only partially charged). Thus, simply by connecting a connector (not shown) to the first rib 410, the foam pump will output a first dose, and moving the connector to connect to the second rib 414, the foam pump will output a reduced dose of foam. In some embodiments, a lost motion connector similar to lost motion connector 114 is secured to either the first rib 410 or the second rib 414 so that the pump also has lost motion during movement.

Figure 5:
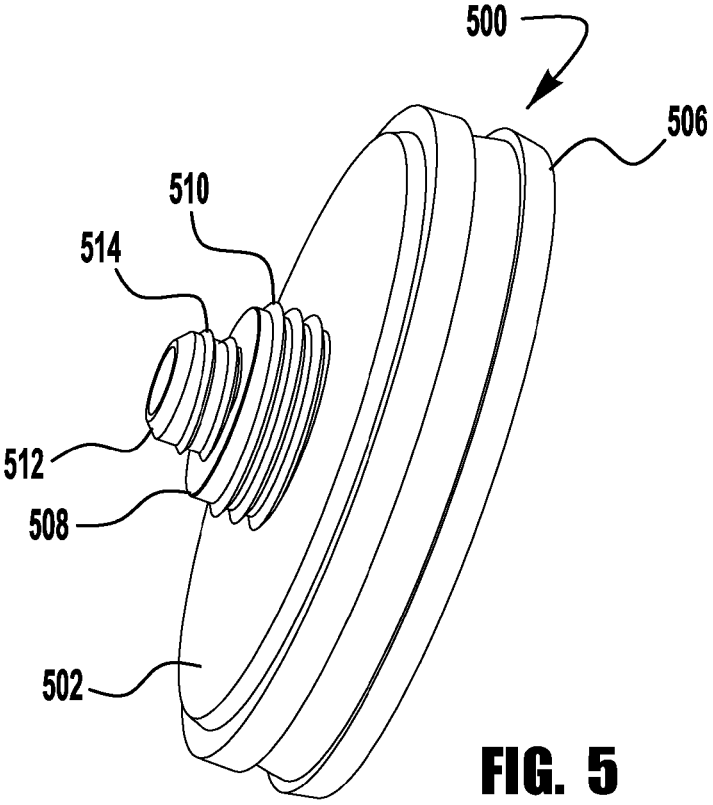
FIG. 5 illustrates another exemplary embodiment of an air piston having multiple connection points for adjusting the output volume of a foam pump.

FIG. 5 illustrates a prospective view of another exemplary air piston 500 for use in embodiments of foam pumps that have adjustable output dosages. Air piston 500 includes sealing member 506 for engaging a wall of a cylindrical air chamber (not shown). Air piston 500 includes a surface 502 that includes a first annular projection 508. First annular projection 508 includes a first threaded portion 510. Air piston 500 includes a second annular projection 512 that includes a second threaded portion 514. A connector (not shown) engages an actuator (not shown) of a dispenser (not shown) and is configured to engage either first threaded portion 510 or second threaded portion 514. In one embodiment, a reducer (not shown) is supplied with the refill unit. The actuator, or the connector, has a female threaded portion that is sized to thread onto first threaded portion 510. If a user wants to connect the actuator to second threaded portion 514, the user threads the reducer (not shown) onto the connector and threads the reducer to the second threaded portion 514. As used herein, the actuator may be a single part or multiple parts linked to one another. The actuator may include the connector, or may be connectable to the connector. When the actuator is engaged with the first threaded portion 510, during operation a first dosage size is dispensed when the dispenser is actuated. When the actuator is engaged with the second threaded portion 514, a second dosage size is dispensed when the actuator is dispensed.

Figure 6:
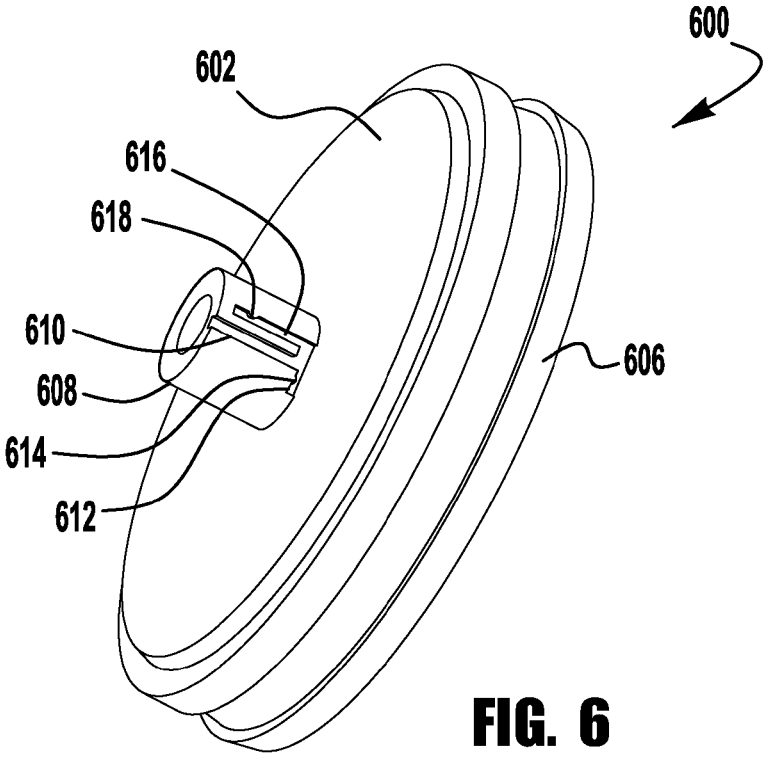
FIG. 6 illustrates an exemplary embodiment of an air piston having multiple connection points for adjusting the output volume of a foam pump, which can also be used for a foam pump having lost motion.

FIG. 6 illustrates a prospective view of an exemplary air piston 600 for use in embodiments of foam pumps that have adjustable output dosages. Air piston 600 includes sealing member 606 for engaging a wall of a cylindrical air chamber (not shown). Air piston 600 includes a surface 602 that includes an annular projection 608. Annular projection 608 includes one or more slots 610 (in some embodiments, the one or more slots are located opposite one another on opposite sides of annular projection 608) that traverse the length of annular projection 608. An adjoining slot 612 (or slots if there are more than one slot 610) extends along the base of annular projection 608 in a first direction. An additional slot 616 extends along the base in a second direction and then extends part way along the length of annular projection 608. To connect air piston 600 to a connector not shown that is connected to, or connectable to, an actuator (not shown), the connector includes mating projections that fit within the slots 610, 612 and 616. The mating projections slide down slot 610 until they reach the surface 602. If air piston 600 is rotated in a first direction the mating projections travel along adjoining slot 612. The mating projections pass rib(s) 614 which serves to retain the mating projections in slot 612. If air piston 600 is rotated in a second direction, the mating projections travel along slot 616 until they pass rib(s) 618, which serves to retain the mating projection at the end of slot 616. Accordingly, during operation of the actuator a first dosage size is dispensed when the connector is engaged in slot 612 and the dispenser is actuated. When the connector is engaged in slot 616, a second dosage size is dispensed when the dispenser is actuated.

In addition, FIG. 6 may be modified slightly to have either a fixed return stroke, or a lost motion return stroke. For example, if rib 618 is moved to the point where slot 616 transitions from traveling along the base of annular projection 608 to traveling along the length of annular projection 608, the portion of slot 616 that extends along the length of projection 608 provides for a lost motion linkage. In that configuration, when the actuator moves toward the air piston 600, the air piston 600 moves to pump air. However, when the actuator moves outward or away from the air piston 600, the air piston 600 does not move until the mating projections travel the length of the slot 616 resulting in the actuator moving a greater distance than the air piston.

Figure 7:
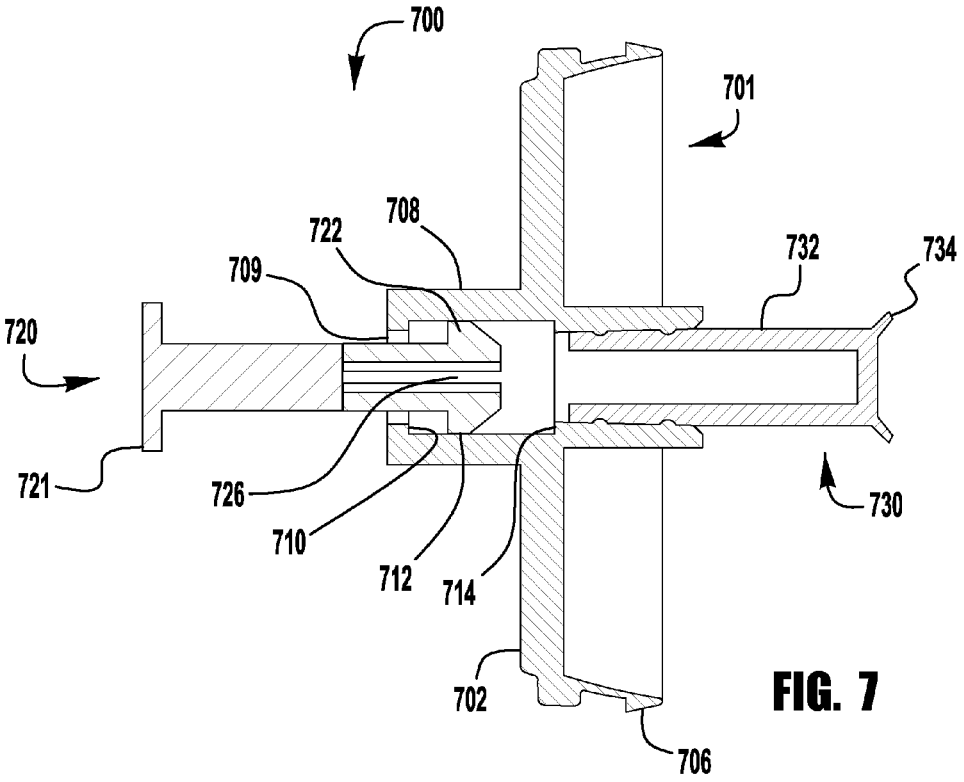
FIG. 7 illustrates a cross-section of an exemplary embodiment of a liquid piston and an air piston linked together with a lost motion linkage.

FIG. 7 illustrates another exemplary lost motion assembly 700 for a lost motion foam pump. In addition, the dispense dosage of lost motion assembly 700 may be adjusted. The lost motion assembly 700 includes an air piston 701 a liquid piston 730 and a connector 720. Liquid piston 730 is secured to air piston 701 and moves with air piston 701. Liquid piston 730 includes a body 732 and sealing member 734. In one embodiment, liquid piston 730 is connected to connector 720 so that lost motion occurs with respect to the air piston 701, but not the liquid piston 730. In one embodiment, the air piston 701 is rigidly connected to connector 720 and a connection similar to the connection in FIG. 7 between connector 720 and air piston 701 is used to connect the connector 720 to the liquid piston. Thus, these optional embodiments would have a lost motion between the liquid piston 730 and the air piston 701.

In the illustrated embodiment, the air piston 701 includes a sealing member 706 that seals against a housing (not shown) of the air compressor portion (not shown) of a foam pump. Air piston 701 includes a surface 702 and an annular projection 708 extending outward therefrom. Annular projection 708 includes an aperture 709 that receives connector 720. The diameter of aperture 709 is less than the diameter of annular projection 708 and a wall 710 is formed at the end of the annular projection 708. In addition, a second wall 714 is located at the other end of the annular projection 708.

Connector 720 includes a connector head 722. Connector head 722, and a portion of connector 720, includes a slot 726. The slot 726 compresses to allow connector head 722 to be compressed to fit through aperture 709. Once connector head 722 passes through aperture 709, slot 726 moves to its expanded position and connector head 722 is retained within annular projection 708 by wall 710. Wall 714 forms an additional boundary for connector head 722. Connector 720 includes an annular projection 721 that may be engaged by an actuator of a dispenser. When the dispenser is actuated, connector 722 moves until connector head 722 contacts wall 714 and then connector 720, air piston 701 and liquid piston 730 move inward. When the actuator is released, connector 720 moves outward until connector head 722 contacts wall 710. Once connector head 722 contacts wall 710, further movement of connector 720 moves air piston 701 and liquid piston 730 outward.

In addition, the lost motion assembly 700 may be easily modified to change the dosage. In one embodiment, a connector (not shown) similar to connector 720 is used, but the connector has a connector head with a different width. A wider connector head results in the stroke of the pump being increased and a larger dose being output. If the connector head is narrower, the stroke of the pump is decreased and a smaller dose is output. Optionally, a ring or clip (not shown) may be inserted on the connector 720 behind the connector head 722 so that the ring or clip contacts wall 710 and thereby effectively increases the width of the connector head 722 to increase the stroke of the pump.

Figure 8:
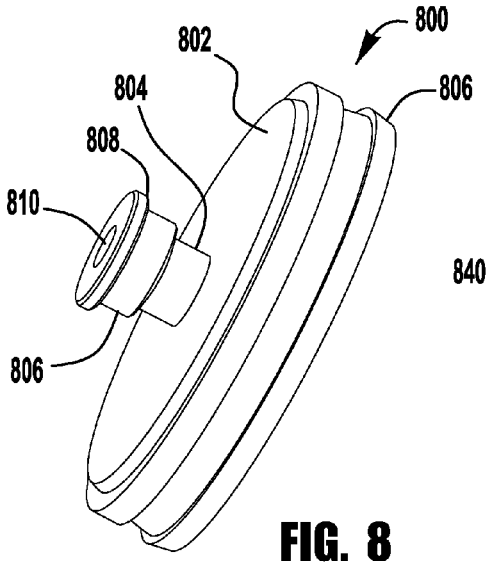
FIG. 8 illustrates a prospective view of an exemplary embodiment of an air piston with an adjustable lost motion linkage.

FIG. 8 illustrates a prospective view of an exemplary air piston 800 for use in embodiments of foam pumps lost motion linkages. Air piston 800 includes sealing member 806 for engaging a wall of a cylindrical air chamber (not shown). Air piston 800 includes a surface 802 that includes a first annular projection 804, a second annular projection 806 and a third annular projection 808. The first annular projection 804 has a diameter that is smaller than the diameter of the second annular projection 806, which has a diameter that is smaller than the diameter of the third annular projection 808. Thus, the annular projections form a step shape. In addition, in one embodiment, a liquid piston is secured to air piston 800. In addition, air piston 800 includes an aperture 810 for linking to a liquid piston.

Figure 8A:
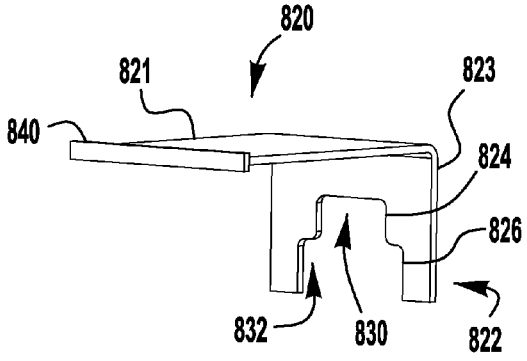
FIG. 8A illustrates an exemplary engagement member for the lost motion linkage of FIG. 8.

FIG. 8A illustrates a connector 820 for connecting to air piston 800. Connector 820 includes a projection 821 that connects to a foam dispenser actuator (not shown) or is part of an actuator. Connector 820 includes an engagement arm 823. Engagement arm 823 includes fork-shaped projections 824, 826 on one end. Opposing fork-shaped projections 824 form a gap 830 there-between. Similarly, opposing fork-shaped projections 826 form a gap 832 there-between. Connector 820 includes projection 840 that links to an actuator (not shown) of a foam dispenser (not shown).

When a refill unit is installed in a dispenser (not shown) and the pump includes air piston 800 and connector 820, a user may set connector 820 to engage the desired step of the annular projections 806, 808. If for example, the user desires a pump that has a fixed output and no lost motion, connector 820 is set so that gap 830 fits over annular projection 804 and engages projection 806 and surface 802. If the user desires the pump to have lost motion, the user positions connector 820 over annular projection 806. Thus, as connector 820 moves inward the connector contacts surface 802 to dispense a dose. As the connector 820 moves back out, the connector 820 does not move air piston 800 until the connector 820 travels far enough for the connector 820 to contact the side of annular projection 808. Accordingly, in this configuration the foam pump is a lost motion foam pump.

Figure 9:
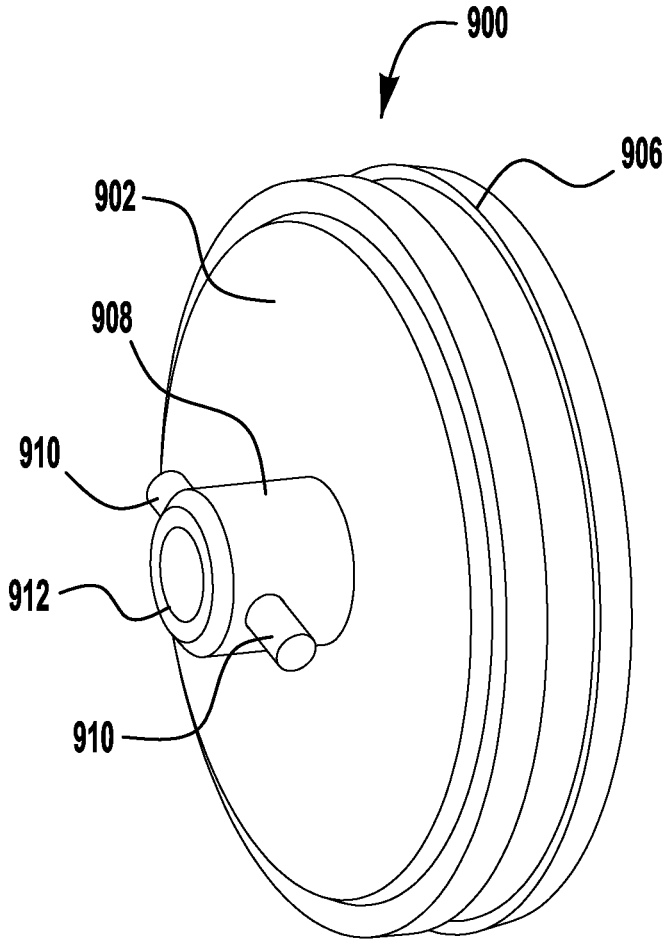
FIG. 9 illustrates a prospective view of an exemplary embodiment of an air piston for use in a convertible foam pump that may be converted between a lost motion pump and a no lost motion pump.

FIG. 9 illustrates a prospective view of yet another exemplary embodiment of an air piston 900 for use in foam pumps described herein. Air piston 900 includes sealing member 906 for engaging a wall of a cylindrical air chamber (not shown). Air piston 900 includes a surface 902 that includes an annular projection 908. Annular projection 908 includes a pair of cylindrical projecting members 910. In addition, air piston 900 includes an aperture 912 for connecting to a liquid piston (not shown).

Figure 9A:
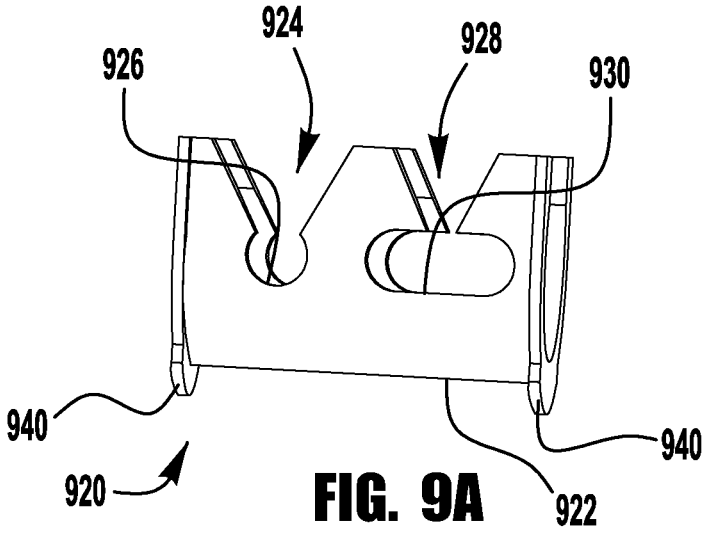
FIG. 9A illustrates a connector for connecting to the exemplary air piston of FIG. 9.

FIG. 9A illustrates an embodiment of a connector 920 for connecting to an air piston 900. Connector 920 has a partially cylindrical body 922. Body 922 includes a first aperture 926 and a second aperture 930. First aperture 926 is slightly larger than cylindrical projection members 910. Second aperture 930 is elongated and the depth of the slot therein is slightly larger than the diameter of cylindrical projection members 910. An opening 924 allows connector 920 to be snapped over cylindrical projection members 910 for a "no lost motion" foam pump. Opening 928 allows connector 920 to be snapped over cylindrical projections 910 for a "lost motion" foam pump because cylindrical projections 910 may move back and forth in elongated aperture 930. Annular projections 940 on each end of cylindrical body 922 are engagement members for connecting to an actuator (not shown). Thus, the actuator can engage with connector 920 when connector 920 is engaged in either position.

In some embodiments, the exemplary refill units may be shipped with multiple lost motion connectors. A user may decide which lost motion connector to use based upon the desired output. For example, a first lost motion connector could result in no lost motion, and the refill unit will output a full dose. A second lost motion connector could result in a first reduced dose output and a third lost motion connector could result in a second reduced dose. Thus, the user could decide which lost motion connector to use.

As used herein, the term connector may refer to a portion of the air piston, a portion of the liquid piston, a portion of the actuator, or a part connected to one of these portions. In addition, the structure described as being on the air piston may be on the air piston, liquid piston or on the actuator.

Although the embodiments shown and described herein contain piston pumps, exemplary embodiments of lost motion pumps may include other pumps, such as dome pumps, bellows pumps and the like. In such cases, the lost motion connector us used to engage the mechanism that causes the actuate the pumps.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A dispenser having a lost motion foam pump comprising:

a dispenser housing;

an actuator for moving a liquid pump piston and an air pump piston;

an engagement member having a u-shaped opening;

the engagement member having one or more projection members that extend into the u-shaped opening to engage at least one of the-liquid pump piston and the air pump piston when a refill unit is installed in the dispenser;

wherein movement of the actuator in a first direction moves the liquid pump piston and an air pump piston to discharges foam;

wherein movement of the actuator a first distance in a second direction does not move the liquid pump piston; and wherein further movement of the actuator in the second direction moves the liquid piston to at least partially recharge the foam pump.

2. The dispenser of claim 1 wherein the actuator includes a slot for securing the engagement member to the actuator.

3. The dispenser of claim 1 wherein the engagement member is removable from the actuator.

4. The dispenser of claim 1 wherein the stroke of the actuator is selected so that full movement of the actuator in the first direction completely discharges the contents of the foam pump.

5. The dispenser of claim 1 wherein the engagement member comprises a plurality of projections.

6. The dispenser of claim 4 wherein the actuator contacts the liquid pump piston to move the liquid pump piston in the first direction.

7. The dispenser of claim 1 further comprising a connector linking the engagement member to the liquid piston.

8. The dispenser of claim 1 wherein the connector comprises a flat surface of an annular projection.

9. The dispenser of claim 8 wherein at least one of the flat surface and the one or more projection members are fingers.

10. A foam dispenser having lost motion comprising:

a dispenser housing;

an actuator;

a lost motion connector for linking the actuator to a liquid piston and an air piston of a refill unit;

wherein movement of the lost motion connector in a first direction moves the liquid and air pistons to contract the liquid chamber and the air chamber;

wherein movement of the lost motion connector a first distance in a second direction results in lost motion between the actuator and the liquid piston and the air piston; and wherein continued movement of the lost motion connector a second distance in the second direction moves the liquid piston and the air piston and expands the liquid and air chambers.

11. The foam dispenser of claim 10, wherein movement in the second direction partially recharges the liquid chamber and the air chamber.

12. The foam dispenser of claim 10, wherein movement in the first direction fully discharges the liquid chamber and the air chamber.

13. The foam dispenser of claim 10 wherein the lost motion connector is cylindrical.

14. The foam dispenser of claim 10 wherein the lost motion connector is part of the refill unit.

15. The foam dispenser of claim 10 further comprising a refill unit.

16. A foam dispenser having lost motion comprising:

a dispenser housing;

an actuator;

the actuator having an opening;

a lost motion mechanism for linking the actuator to a liquid piston and the air piston of a refill unit;

wherein movement of the lost motion mechanism in a first direction moves the liquid and air pistons to contract the liquid chamber and the air chamber;

wherein movement of the lost motion mechanism a first distance in a second direction results in lost motion between the actuator and the liquid piston and the air piston; and wherein continued movement of the lost motion mechanism a second distance in the second direction moves the liquid piston and the air piston and expands the liquid and air chambers.

17. The foam dispenser of claim 16 wherein at least a portion of the lost motion mechanism comprises a u-shaped member having one or more inwardly extending projections for linking to the liquid piston and the air piston.

18. The foam dispenser of claim 16 wherein at least a portion of the lost motion mechanism comprises a cylindrical member.

19. A method of dispensing a dose of foam soap from a foam pump having an air piston and a liquid piston that is less that is than a maximum dose of foam soap comprising:

providing a dispenser having an actuator that has a stroke length that is capable of dispensing a maximum dose of foam soap;

providing a refill unit having a container and a foam pump that has an air piston and a liquid piston;

providing a lost motion mechanism;

wherein the lost motion mechanism allows movement of the actuator in a dispense direction to cause the liquid piston and air piston to move to a substantially fully dispensed position;

wherein the lost motion mechanism allows movement of the actuator away from the dispensed position for a first distance without moving the liquid piston and the air piston; and wherein movement of the actuator away from the dispensed position for a second distance causes movement of the liquid piston and the air piston.

20. The method of claim 19 wherein the fully dispensed position occurs when the actuator moves toward the pump.

* * * * *